US005377373A

United States Patent [19]

Shirai

[11] Patent Number: 5,377,373

[45] Date of Patent: Jan. 3, 1995

[54] BOTTOM STRUCTURE OF A BED

[75] Inventor: Kunito Shirai, Togane, Japan

[73] Assignee: Paramount Bed Company Limited, Tokyo, Japan

[21] Appl. No.: 170,716

[22] Filed: Dec. 21, 1993

[30] Foreign Application Priority Data

Dec. 25, 1992 [JP] Japan ..... 4-89072[U]

[51] Int. Cl.[6] ..... A61G 7/04

[52] U.S. Cl. ..... 5/613; 5/400; 5/465

[58] Field of Search ..... 5/613, 617, 400, 401, 5/465, 618

[56] References Cited

U.S. PATENT DOCUMENTS

| | | | |
|---|---|---|---|
| 3,780,387 | 12/1973 | Propst | 5/465 X |
| 4,148,521 | 4/1979 | Van Houk | 5/465 X |
| 4,815,155 | 3/1989 | Sommers | 5/417 X |
| 5,109,554 | 4/1992 | Borders et al. | 5/618 X |

FOREIGN PATENT DOCUMENTS

| | | |
|---|---|---|
| 51-30716 | 9/1976 | Japan . |
| 54-26164 | 8/1979 | Japan . |
| 54-37594 | 11/1979 | Japan . |

*Primary Examiner*—Michael F. Trettel
*Attorney, Agent, or Firm*—Townsend & Banta

[57] ABSTRACT

The present invention provides a bottom structure for a bed having a bottom lifting mechanism, comprising bendable and extensible flexible hollow bottom members, provided in the bottom structure allowing the bottom to be bent.

3 Claims, 2 Drawing Sheets

BOTTOM STRUCTURE OF A BED

CROSS-REFERENCE TO RELATED APPLICATION

This application claims the priority of Japanese Patent Application No. 89072/1992 filed on Dec. 25, 1992, which is incorporated herein by reference.

BACKGROUND OF THE INVENTION

1. Field of the Invention

The present invention relates to a bottom structure for a bed which can be bent to a proper curvature while allowing a patient to continue feeling relaxed even though the bottom is being partially lifted.

2. Description of Related Art

Many of recent beds are equipped with any bottom lifting mechanism and various mechanisms are available. An ordinary liftable bed has a back bottom portion simply connected to a waist bottom portion. The waist bottom portion is simply connected to a leg bottom portion. When the back bottom portion is lifted, the joint between the back and waist portions acts as a pivot, (i.e. forming an actual fulcrum), while when the leg portion is lifted, the joint between the waist and leg bottom portions also acts as a pivot.

Therefore, as the back bottom portion is lifted up forming an angle, the angular space between the back and waist bottom portions near the joint is narrowed, and unless the angle fits the body of the patient in the bed, the waist, abdomen, and underside of the patient's legs are uncomfortably pressed by the mattress.

SUMMARY OF THE INVENTION

The present invention has achieved a solution to the above cited problems. The object of the present invention is to provide a bottom structure for a bed, which can be bent in appropriate curves to provide gentle curvature at the bent portions of the bed so as to minimize any displeasing pressure points for the patient.

To the solve the above cited problem, the present invention provides a bottom structure for a bed having a bottom lifting mechanism, comprising bendable and extensible flexible hollow bottom members, provided in the bottom structure allowing the bottom to be bent.

In the above bottom structure for a bed, the flexible hollow bottom members may be formed by blow molding of a thermoplastic resin. If the bottom is partially lifted, the bendable and extensible flexible hollow bottom members are bent, letting the bottom structure form a gentle curve.

Since the flexible hollow bottom members may be formed by using blow molded thermoplastic resin, they can be made as a single part, made at a low manufacturing cost and can reduce the number of assembly steps.

| Symbols | |
|---|---|
| 1 | Bed |
| 2 | Bottom |
| 3 | Actuator |
| 4 | Back Lifting Arm |
| 5 | Knee Lifting Arm |
| 6 and 7 | Roller |
| 8 | Flexible Hollow Bottom Member |

DETAILED DESCRIPTION OF THE INVENTION

The bottom structure for a bed of the present invention is described below in reference to the attached drawings.

Figure 1:
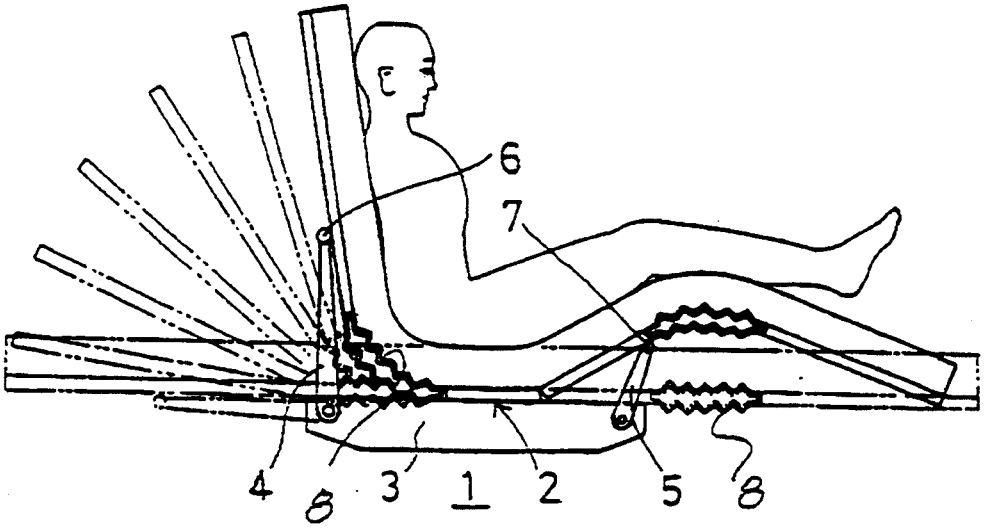
FIG. 1 is a side illustration showing a bed having a bottom structure of the present invention.

FIG. 1 shows a bed 1, to which the bottom structure of the present invention is applied. The bed 1 can have the bottom 2 lifted at the back and knee portions by an electric actuator 3 provided below the bottom 2. The actuator 3 is provided with back lifting arms 4 for lifting the back portion and knee lifting arms 5 for lifting the knee portion. The back lifting arms 4 contact the bottom 2 on the underside at the portion corresponding to the back portion, through rollers 6, and the knee lifting arms 5 contact the bottom 2 on the underside at the portion near the patient's knees, through rollers 7.

In the bed 1, flexible hollow bottom members 8 are provided at the bendable portion between the back and waist portions of the bottom 2 and at the portion corresponding to the patient's knees.

Figure 2:
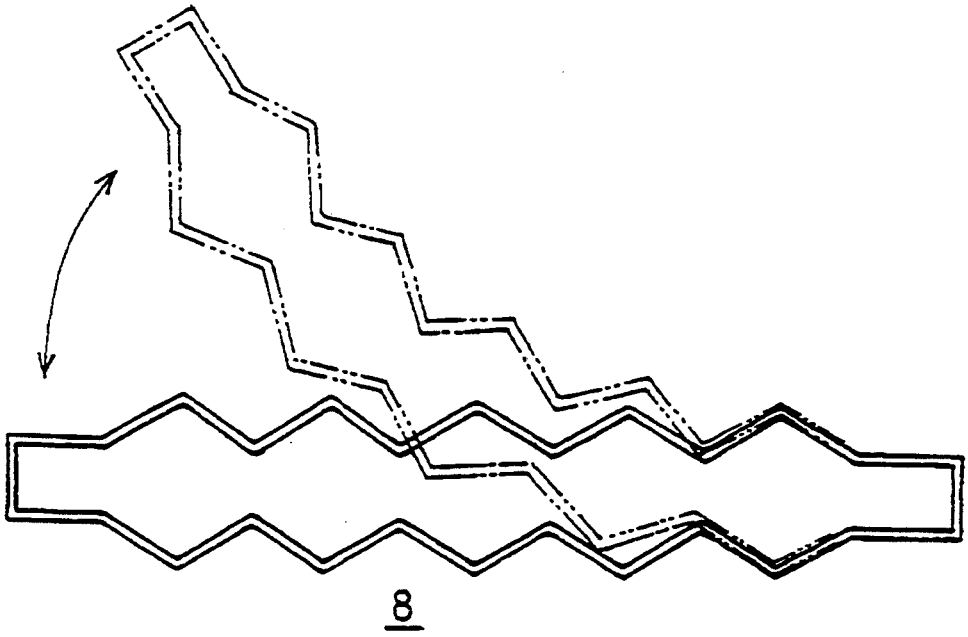
FIG. 2 is an enlarged sectional illustration showing an embodiment of a flexible hollow bottom member at a bendable portion of the bottom structure shown in FIG. 1.
Figure 3:
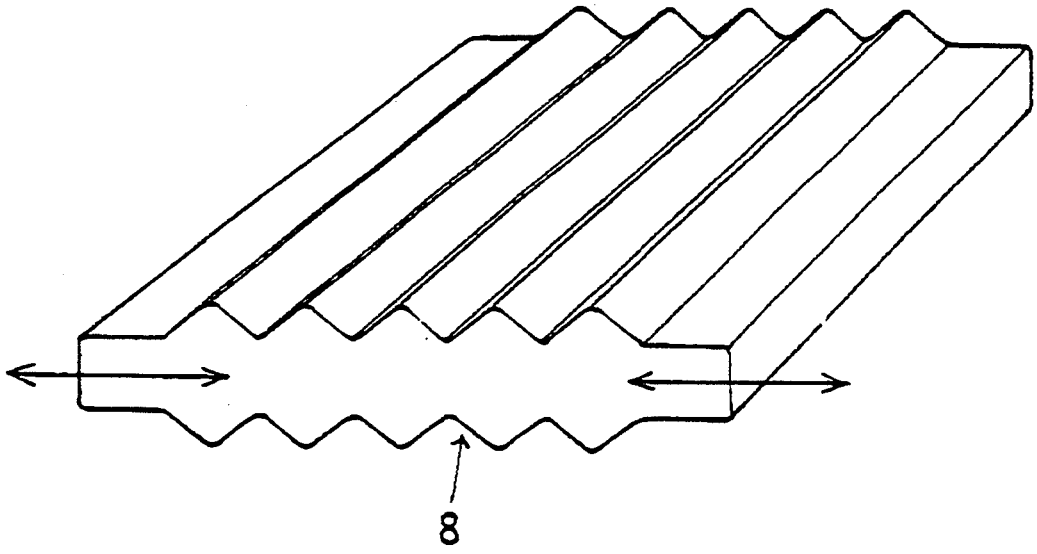
FIG. 3 is a perspective view showing a flexible hollow bottom member.

The flexible hollow bottom members 8 are preferably formed to be hollow and zigzagged on the upper and lower surfaces, using a blow molded thermoplastic resin (see FIGS. 2 and 3).

In the bed 1 with the above bottom structure, when the actuator 3 is started to lift the back and knee portions, the flexible hollow bottom members 8 are bent, being contracted on the upper side and extended on the underside, so that the bottom 2 may be bent to form an overall gentle curve (see FIG. 2).

Since the flexible hollow bottom members 8 are located at any bendable position and are not sharply bent, but rather bent in a larger radius of curvature, the adjustment of the angle of bend is not required.

When the bottom is lifted at the back and knee portions, the bent portions form a gentle curve as a result of the flexible hollow bottom members 8. Therefore, the waist, abdomen, and underside of the patient's legs at the bent portions are not uncomfortably pressed by the mattress.

The flexible hollow members 8 are single parts made using blow molded thermoplastic resin which is an advantage in view of manufacturing costs.

The bottom 2 can be completely assembled simply by connecting the flexible hollow bottom members 8 between the ordinary bottom portions 2 corresponding to the back, waist and legs of the patient. Therefore, the number of assembling steps can be small. Furthermore, since they are hollow parts made of a thermoplastic resin, they are bendable, extensible, and light weight.

Moreover, since the bottom 2 can be formed as a seamless whole, cleaning is easy. As described above, the present device has the following effects:

1. Since the bottom structure is provided with bendable and extensible flexible hollow bottom members, it can be lifted at the back and knee portions without causing any displeasing pressure.

2. Since the flexible hollow bottom members are comprised of single parts formed by blow molding of a thermoplastic resin, they can be manufactured at a low cost and can reduce the number of steps of assembly.
3. Since the flexible hollow bottom members are hollow, they provide a bottom structure of reduced weight.

What is claimed is:

1. A bottom structure for a bed having moveable flexible sections connected to moveable rigid sections, each of said flexible sections being hollow and extensible and formed of flexible plastic, each flexible section having upper and lower walls with a plurality of V-shaped corrugations formed in both the upper and lower walls, said V-shaped corrugations extending transverse to a longitudinal axis of said bottom structure, said corrugations permitting the flexible section to bend either up or down.

2. A bottom structure according to claim 1 wherein a lifting mechanism is connected to a rigid section whereby at least one section of the bed can be moved either up or down.

3. A bottom structure according to claim 1 wherein said flexible section is comprised of blow molded thermoplastic resin.

* * * * *